US010736363B2

(12) United States Patent
David

(10) Patent No.: US 10,736,363 B2
(45) Date of Patent: Aug. 11, 2020

(54) HIGH-PERFORMANCE SPORTS BRA

(71) Applicant: Katharine B. David, Escondido, CA (US)

(72) Inventor: Katharine B. David, Escondido, CA (US)

( * ) Notice: Subject to any disclaimer, the term of this patent is extended or adjusted under 35 U.S.C. 154(b) by 172 days.

(21) Appl. No.: 15/919,166

(22) Filed: Mar. 12, 2018

(65) Prior Publication Data

US 2018/0255839 A1 Sep. 13, 2018

Related U.S. Application Data

(60) Provisional application No. 62/470,496, filed on Mar. 13, 2017.

(51) Int. Cl.
*A41C 3/00* (2006.01)
*A41C 3/06* (2006.01)
*A63B 71/12* (2006.01)

(52) U.S. Cl.
CPC ..... *A41C 3/0057* (2013.01); *A41C 3/0007* (2013.01); *A41C 3/06* (2013.01); *A63B 71/12* (2013.01); *A63B 2071/1208* (2013.01)

(58) Field of Classification Search
CPC ..... A41C 3/0057; A41C 3/007; A41C 3/06; A41C 3/10; A63B 71/12; A63B 2071/1208
See application file for complete search history.

(56) References Cited

U.S. PATENT DOCUMENTS

| | | | | |
|---|---|---|---|---|
| 1,545,441 | A * | 7/1925 | Newman | A41C 3/00 450/4 |
| 1,721,739 | A | 7/1929 | Kennedy | |
| 2,451,001 | A | 10/1948 | Lash | |
| 6,755,717 | B2 * | 6/2004 | Smith | A41C 3/0057 128/869 |
| 7,381,113 | B2 * | 6/2008 | Hori | A41C 3/0057 450/55 |
| 7,591,706 | B2 | 9/2009 | Barbour et al. | |
| 7,938,711 | B1 | 5/2011 | Johnston | |
| 9,215,896 | B2 | 12/2015 | Smith | |
| 9,681,691 | B1 * | 6/2017 | Hubbs | A41C 3/005 |
| 10,123,574 | B2 | 11/2018 | Wilson | |
| 10,136,681 | B1 * | 11/2018 | Malik | A41C 3/0035 |
| 2014/0051330 | A1 * | 2/2014 | Lin | A41C 3/0007 450/86 |
| 2016/0286868 | A1 * | 10/2016 | Cardaci | A41C 3/06 |
| 2016/0309796 | A1 * | 10/2016 | DeCotiis | A41C 3/06 |
| 2018/0242653 | A1 * | 8/2018 | Brandt | A41C 3/0057 |

* cited by examiner

*Primary Examiner* — Kristen Matter
(74) *Attorney, Agent, or Firm* — Timothy W. Fitzwilliam; Adam H. Owens

(57) ABSTRACT

A strapless sports bra is optimally designed to provide extra support and better immobilization of breasts during intense workouts or vigorous activity. As is unique in a preferred embodiment, the sports bra is strapless and does not pull over a wearer's head. Also innovative, two back straps will overlap and crisscross, providing support. Strategically placed and designed padding will further protect and support a chest area; and as is important with relatively thick bras, the invention includes a breathable outer skin and inner padding support.

7 Claims, 7 Drawing Sheets

HIGH-PERFORMANCE SPORTS BRA

PRIORITY CLAIM

This patent application claims benefit of the priority date of U.S. Prov. Pat. App. Ser. No. 62/470,496 filed on Mar. 13, 2017 entitled "High-Performance Strapless Sports Bra;" accordingly, the entire contents of this patent submission is hereby expressly incorporated by reference.

BACKGROUND OF THE INVENTION

Field of the Invention

The present invention pertains generally to sports brassieres. More particularly, the invention relates to a wireless and strapless sports brassiere which eliminates shoulder strap tan lines and provides full breast support while minimizing "breast bounce" during high-performance type physical activities and exercise such as running, playing tennis, playing soccer, jogging, hiking, and other rigorous type exercise and activities.

Description of the Prior Art

Sports Bras for physical activity and exercise have been known for decades and improvements of the art are frequently provided. A relatively old example is provided by Daniel J. Kennedy, entitled "BREAST PROTECTOR", U.S. Pat. No. 1,721,739, and was awarded patent protection in 1929. As told by Kennedy, his invention relates to a breast protector garment for protecting the breasts of a female against injuries resulting from athletic sports or other hazards in which the breasts are likely to be bruised or otherwise hurt. Kennedy's invention comprises two groups of inflatable tubular ringed breast cups attached to a vest having shoulder straps.

A relatively newer example is provided by Yvonne Johnston, entitled "ADJUSTABLE SPORTS BRASSIERE", U.S. Pat. No. 7,938,711, and was awarded patent protection on May 10, 2011. Johnston discloses an invention relating to an improved fitting and aesthetically pleasing sports brassiere comprising multiple points of adjustability, form fitting means, comforting means and aesthetically pleasing means.

In addition to these sports bra examples, numerous related inventions have come forth purporting to achieve a similar universal objective, each purporting improved success over predecessor sports brassieres to provide the necessary support during exercise. However, it is well known that sports bras having straps are at times difficult for the wearer to put on and remove. In addition, straps on sports bras cause tan lines for women who are active or doing physical activities outdoors.

Also known in the art are strapless brassieres. An early example is provided by Leda I. Speiser entitled, "BRASSIERE", U.S. Pat. No. 2,451,001, and was awarded patent protection on Oct. 12, 1948. According to Speiser, her invention relates to a brassiere capable of containing the breasts without the necessity of support from the shoulders. However, Speiser's invention and other similar inventions purporting to improve on the strapless brassiere fail to provide the support and comfort required during high-performance type physical activities and exercise such as running, playing tennis, playing soccer, jogging, hiking, and other rigorous type exercise and activities.

There are a few strapless sports bras advertised on the market as well, however, none provide adequate breast support required during rigorous physical activity. The majority, if not all, of the strapless sports bra in the market are strapless tube top type sports bras made of stretchable Lycra® or similar material. These bras are advertised as yoga sports bras and due to their tube top construction, do not provide adequate support for rigorous physical activity like playing soccer or running. In addition to the lack of support provided, strapless sports bras on the market tend to reorient themselves due to the movement of the wearer's breasts during physical activity, requiring the wearer to frequently readjust the strapless sports brassiere and thus interfering with the wearer's physical activity or exercise.

In light of the above, the present inventor conducted numerous trials using a variety of materials to invent a strapless bra which eliminates tan lines while worn outdoors and most importantly provides full breast support, minimizes "breast bounce", and stays in place on a wearer's torso during high-performance type physical activities and exercise, but however, having multiple embodiments as a matter of preference.

Therefore herein, it is an object of the present invention to provide a High-Performance Strapless Sports Bra that provides the wearer full breast support during high-performance type physical activities such as running, playing tennis or soccer, jogging, hiking, and other rigorous type physical activities and exercise without the need of an underwire or shoulder straps. It is another object of the present invention to provide a strapless sports bra that maintains its position on the wearer's body during rigorous physical activity or exercise, thus eliminating the need for the wearer to readjust the garment while exercising. Still further, it is an object of the present invention to provide a strapless sports bra having appropriately placed support padding at each side of the breast area, along the surface of the breasts, between the breasts and above the breasts, to provide comfort to the wearer by securing and supporting the breasts and minimizing "breast bounce" during physical activities. Yet further, it is an object of the invention to provide a wireless, strapless sports brassiere having a "dual hug" or double enclosure design with supportive materials that will keep the bra on the wearer's body and keep it fully secured without the need for readjustment. Further still, it is an object of the invention to provide a strapless sports bra that eliminates the creation of tan lines while exercising outdoors. And yet still further the invention seeks to provide users means to receive a great tan while engaging in outdoor exercise. Further yet, it is an object of the present invention to provide a breathable strapless sports bra that wicks moisture away from the wearer's skin. Additionally still, it is an object of the present invention to provide a strapless sports bra that is easy for the wearer to put on and to remove.

BRIEF SUMMARY OF THE INVENTION

The present invention specifically addresses and alleviates the above mentioned deficiencies, more specifically, the present invention in a first aspect is a high-performance sports bra comprising: a front panel including a left and a right cup area; a base support strap configured underneath the front panel providing security and support to the left and the right cup area; an inner back strap configured to a first side of the front panel; and an outer back strap configured to a second side of the front panel, the second side of the front panel opposite the first side, wherein the inner back strap is removably coupled to a second lateral side of the sports bra adjacent to the second side of the front panel, and wherein the outer back strap is removably coupled to a first lateral side of the sports bra adjacent to the first side of the front panel, further wherein the sports bra is devoid of any shoulder strap (or neck strap) thereby being a sports bra that is a strapless sports bra.

In this first aspect but not in other embodiments, the front panel begins at the first side of the front panel and continues to the second side of the front panel and does not continue around to a rear of the sports bra, or to the inner and outer back straps, the base support strap providing support to the left and the right cup area.

Also in this aspect, the invention may be characterized wherein the inner back strap crisscrosses with the outer back strap thereby providing a dual hug support further comprising a crisscross incident angle of 30 plus or minus 10 degrees at a bottom rear of the sports bra. Further the invention is characterized wherein the inner back strap is removably coupled to the second lateral side of the sports bra via an inner back strap fastener piece adjacent to the second side of the front panel, and wherein the outer back strap is removably coupled to a first lateral side of the sports bra via an outer back strap fastener piece adjacent to the first side of the front panel.

The invention in this aspect yet further includes an internal breast support layer covered by an outer skin, the internal breast support layer comprising: an inner pad support layer covered by an outer skin; and a left and a right individual cup pad insert disposed into the inner pad support, and opposite the outer skin with respect to the inner pad support layer. Also included is an inner skin fabric contacting a wearer's skin that covers the left and the right individual cup pad inserts. Yet still further the invention in this aspect includes: a first semi-rigid rod at the first side of the front panel; and a second semi-rigid rod at the second side of the front panel, wherein the internal breast support layer further comprises a third and a fourth semi-rigid rod configured adjacent to the left and the right individual cup pad inserts, the first, second, third and fourth semi rigid rods providing a partial endoskeleton and a measure of stiffness to the sports bra.

Importantly in this aspect, the invention is characterized wherein the internal breast support layer has a thickness being greatest at a center line (y-axis). Further wherein the front panel has a continuous smooth curvature in a top aspect along an x-y plane.

The invention in a second aspect is characterized as a sports bra comprising: a front panel comprising a left and a right cup area; a base support strap configured underneath the front panel providing security and support to the left and the right cup area; and an internal breast support layer covered by an outer skin, wherein the internal breast support layer has a thickness being greatest at a center line, y-axis in a top aspect. Further in the x-y plane, the front panel has a continuous smooth curvature in a top aspect.

The invention in this aspect is additionally characterized in that the internal breast support layer comprises: an inner pad support layer covered by an outer skin; and a left and a right individual cup pad insert disposed into the inner pad support, and opposite the outer skin with respect to the inner pad support layer. Also included is that an inner skin fabric contacting a wearer's skin covers the left and the right individual cup pad inserts.

The invention in this second aspect is additionally characterized as comprising: an inner back strap configured to a first side of the front panel; and an outer back strap configured to a second side of the front panel, the second side of the front panel opposite the first side, wherein the inner back strap is removably coupled to a second lateral side of the sports bra adjacent to the second side of the front panel, and wherein the outer back strap is removably coupled to a first lateral side of the sports bra adjacent to the first side of the front panel, further wherein the sports bra is devoid of any shoulder strap (or neck strap) thereby being a sports bra that is a strapless sports bra.

While the apparatus and method has or will be described for the sake of grammatical fluidity with functional explanations, it is to be expressly understood that the claims, unless expressly formulated under 35 USC § 112, or similar applicable law, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC § 112 are to be accorded full statutory equivalents under 35 USC § 112, or similar applicable law. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF PREFERRED EMBODIMENTS

Figure 1:
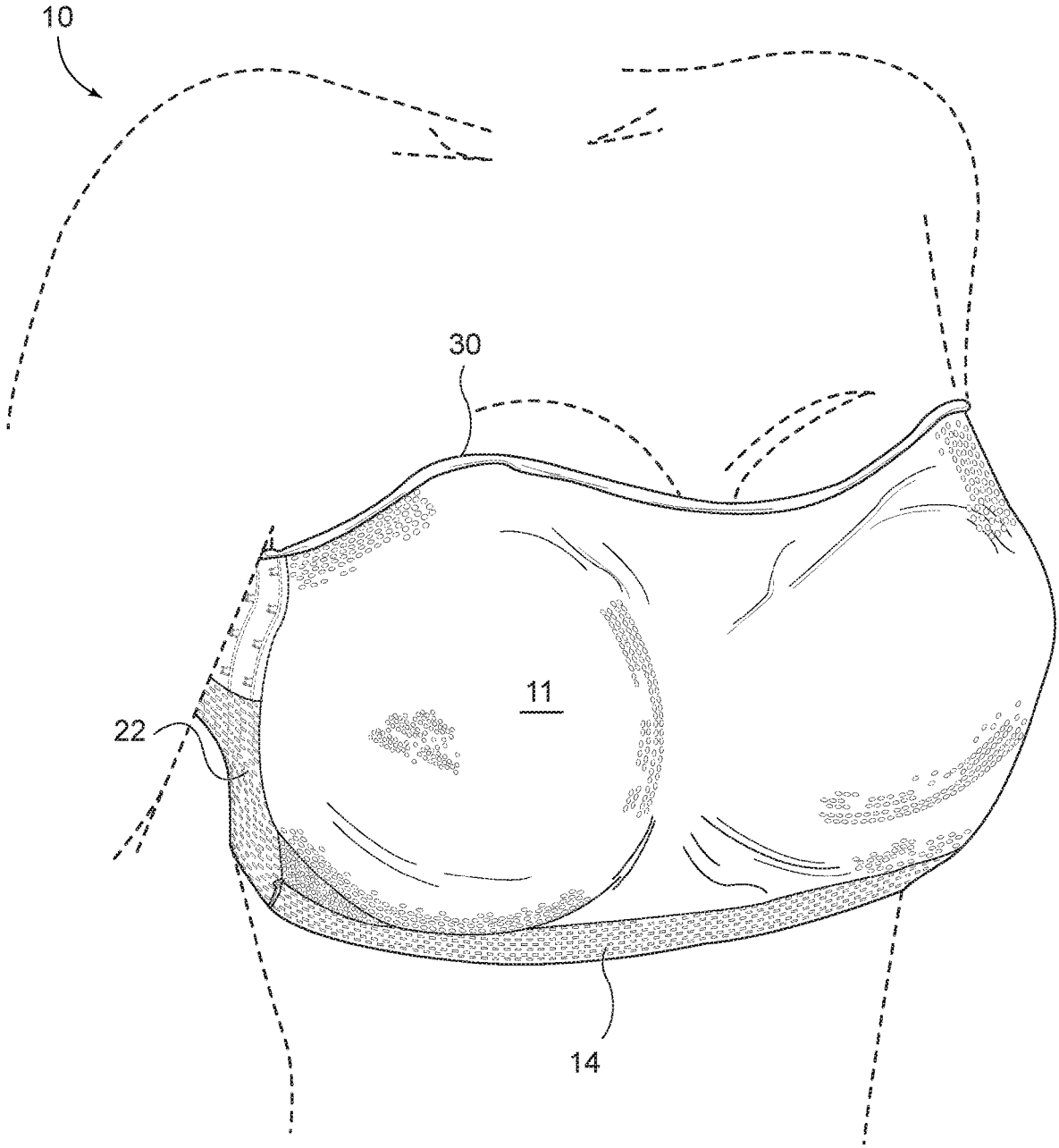
FIG. 1 is a perspective view of a first preferred embodiment of the present invention in a position of use.
Figure 2:
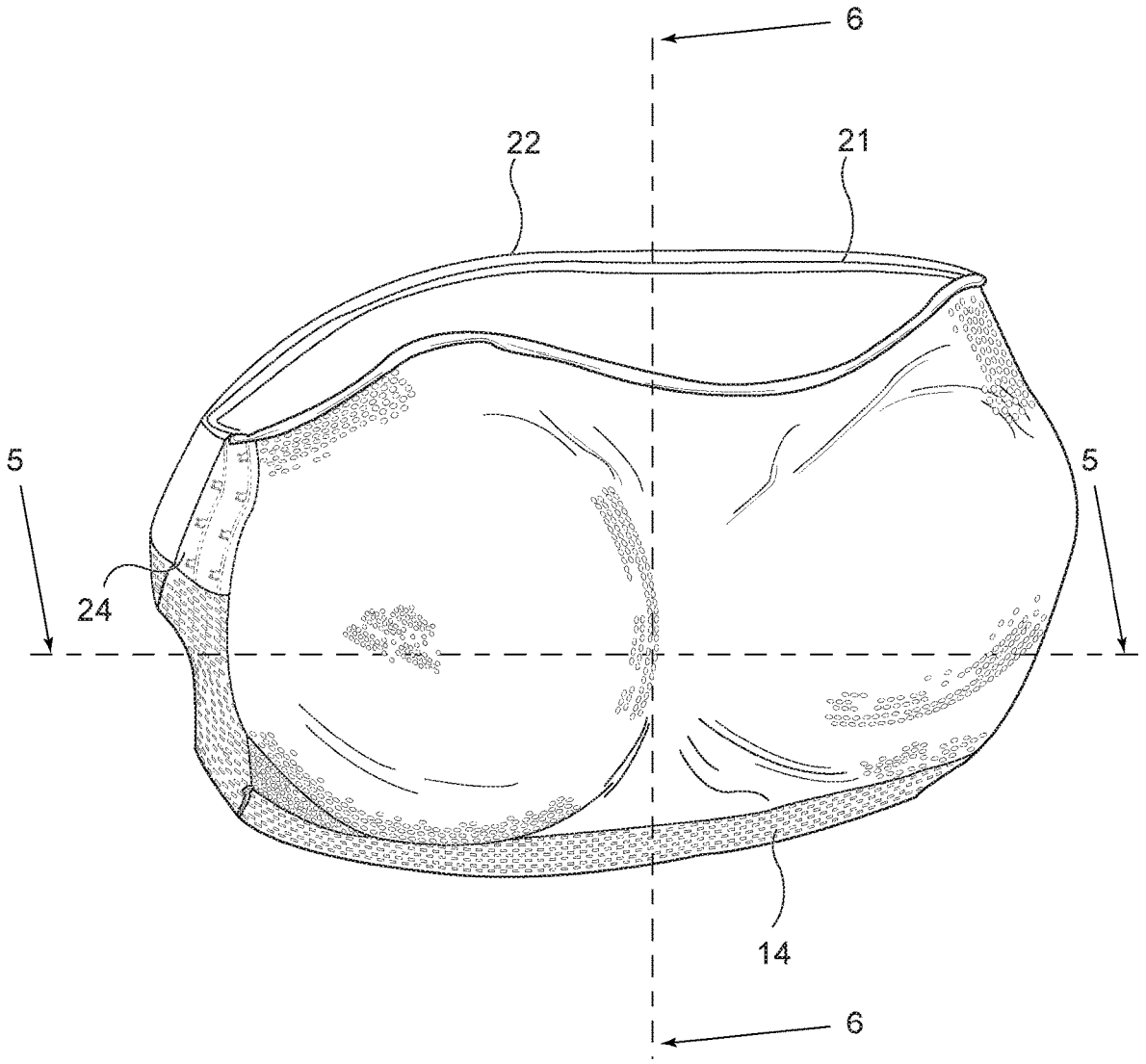
FIG. 2 is an additional front perspective view of the first preferred device with the wearer removed revealing the entire bra.
Figure 8:
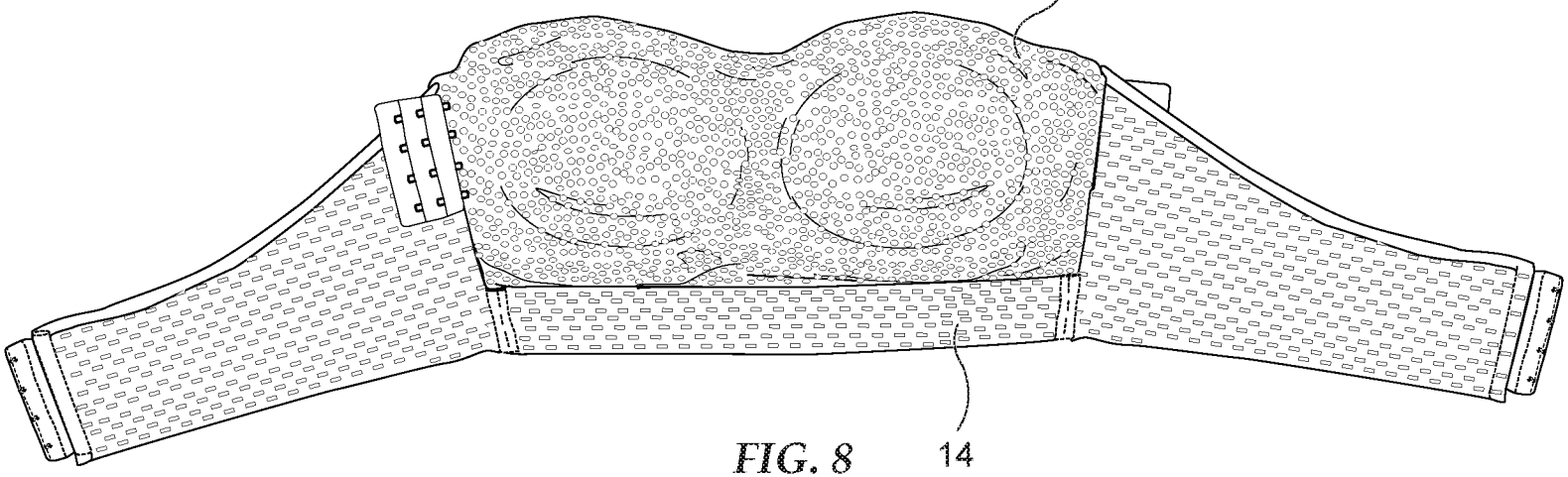
FIG. 8 is an additional rear isometric view with certain components rearranged.

Initially with regard to FIG. 1, a first preferred invention embodiment 10 is shown as worn by a user. Illustrated in perspective from a right side aspect, front panel 11 is supported underneath by base support strap 14. On the right side (also the second side 16 of front panel 11 herein), outer back strap 22 extends therefrom. Internal breast support layer 30 is further detailed herein. FIG. 2 provides an additional front perspective view of the first preferred device with the wearer removed revealing the entire high-performance sports bra. Importantly, the invention 10 provides overlapping back straps 21, 22. Also regarding FIG. 2, a right side/inner fastener piece is shown in dashed lines. It should be appreciated that right/inner sides 24 and left/outer side 23 could be swapped as illustrated in FIG. 8.

Figure 3:
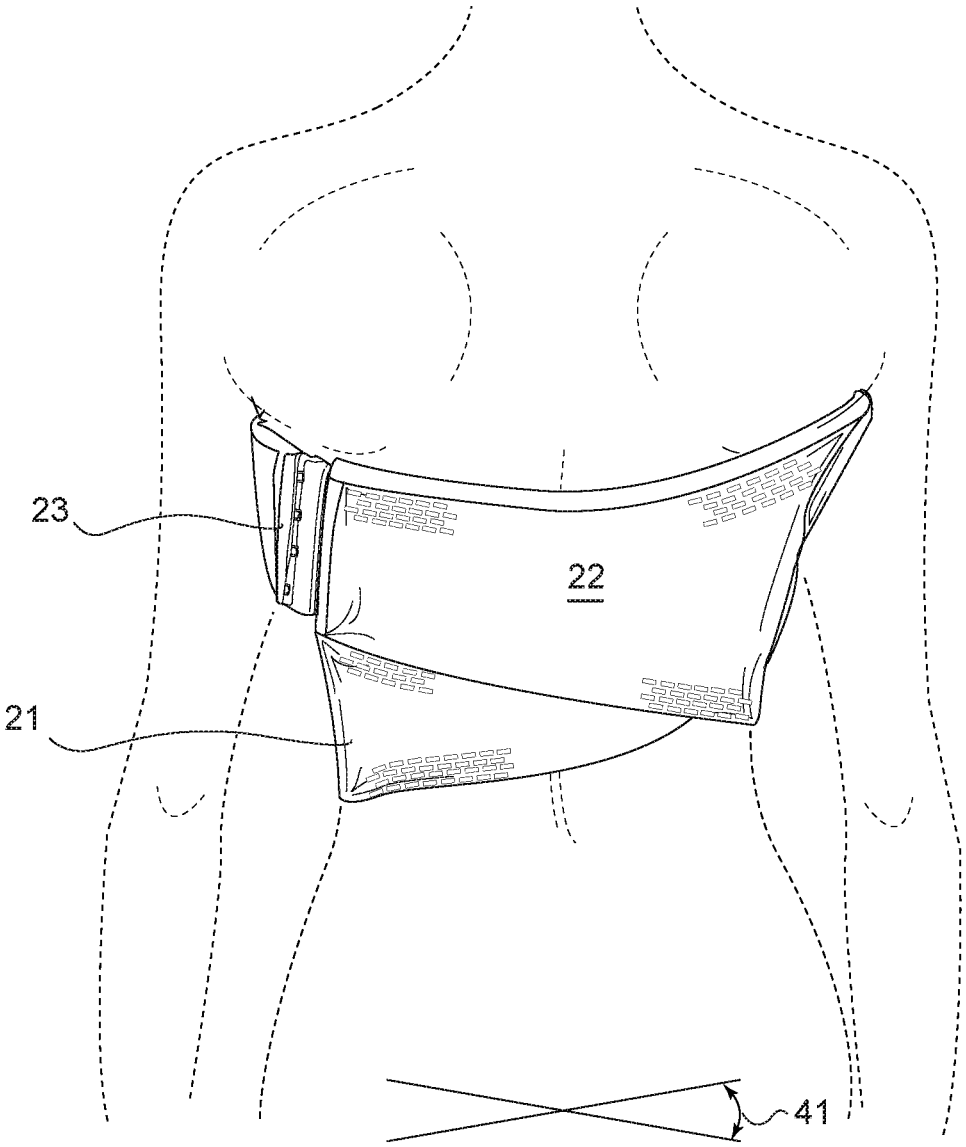
FIG. 3 is a rear perspective view of the device as worn by a user.

With reference to FIG. 3, a rear perspective view of the bra is shown wherein inner 21 and outer 22 back straps crisscross and provide a dual hug supporting even particularly large breast areas 12, 13. It has been observed that a crisscross incident angle 41 of thirty plus or minus ten degrees at a bottom rear of the sports bra provides the optimum support with not bunching up excessively between inner 21 and outer 22 sides 23, 24.

Figure 4:
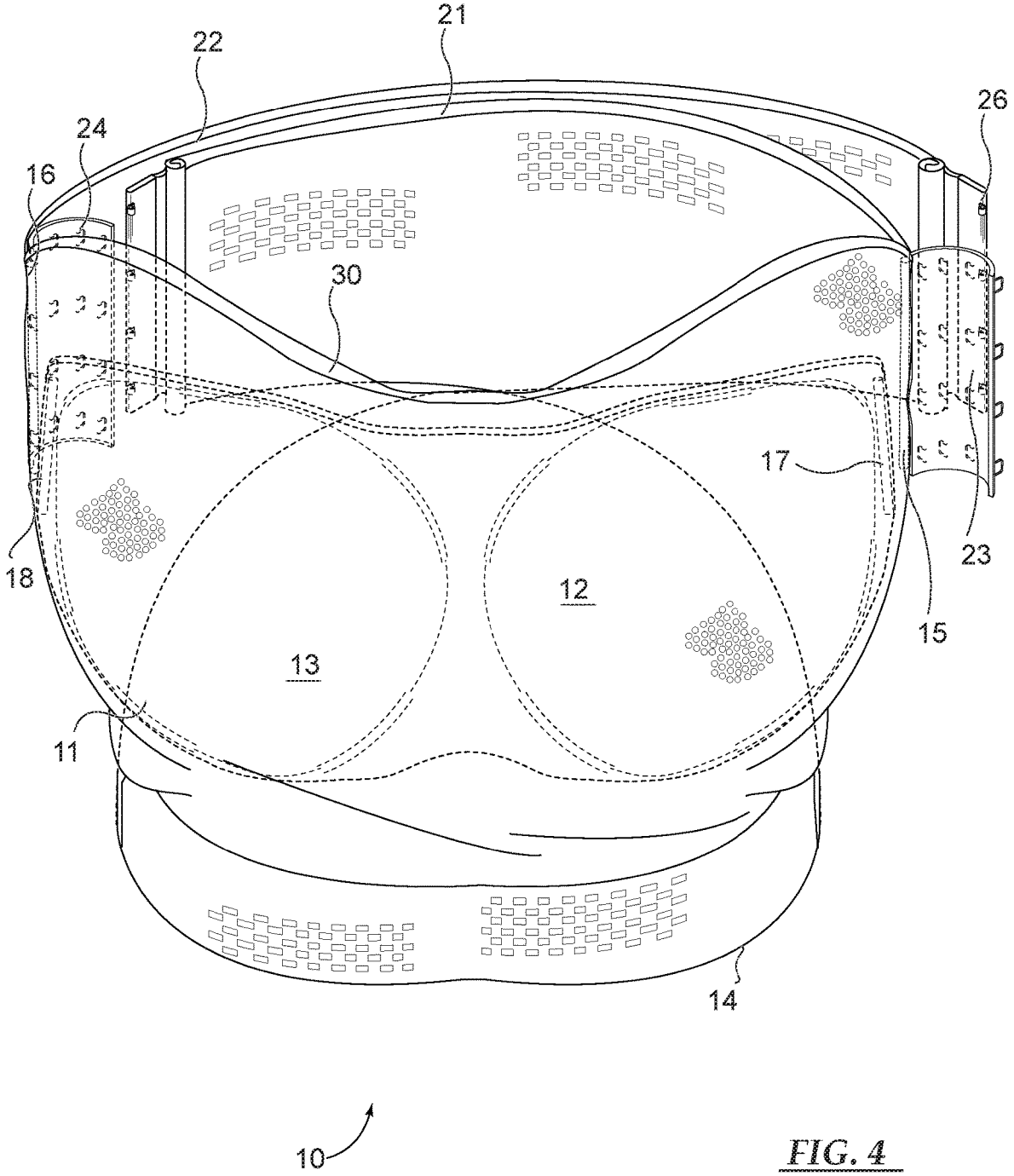
FIG. 4 is an additional perspective view of the sports bra from a frontal vantage point.

Turning to FIG. 4, an additional perspective view of the sports bra from a frontal vantage point is provided having obscured components revealed with dashed lines. A unique aspect of the bra is that is has first 15, second 16, third 17, and fourth 18 semi-rigid rods providing a partial endoskeleton and structural support to the bra 10. Rods 15, 16, 17, and 18 are relatively small in length and diameter and therefore hardly noticed by a wearer. Also, rods are comprised of lightweight polymer material. Specifically, a first semi-rigid rod 15 is provided at the first (left breast) side of the front panel 11; and a second semi-rigid rod 16 is provide at the second side of the front panel 11. Also, an internal breast support layer 30 further comprises a third 17 and a fourth 18 semi-rigid rod configured adjacent to the left 34 and the right individual cup pad inserts 35 (see in conjunction with FIG. 5). As stated, the first 15, second 16, third 17 and fourth 18 semi rigid rods provide a partial endoskeleton and a measure of stiffness to the sports bra 10.

Figure 5:
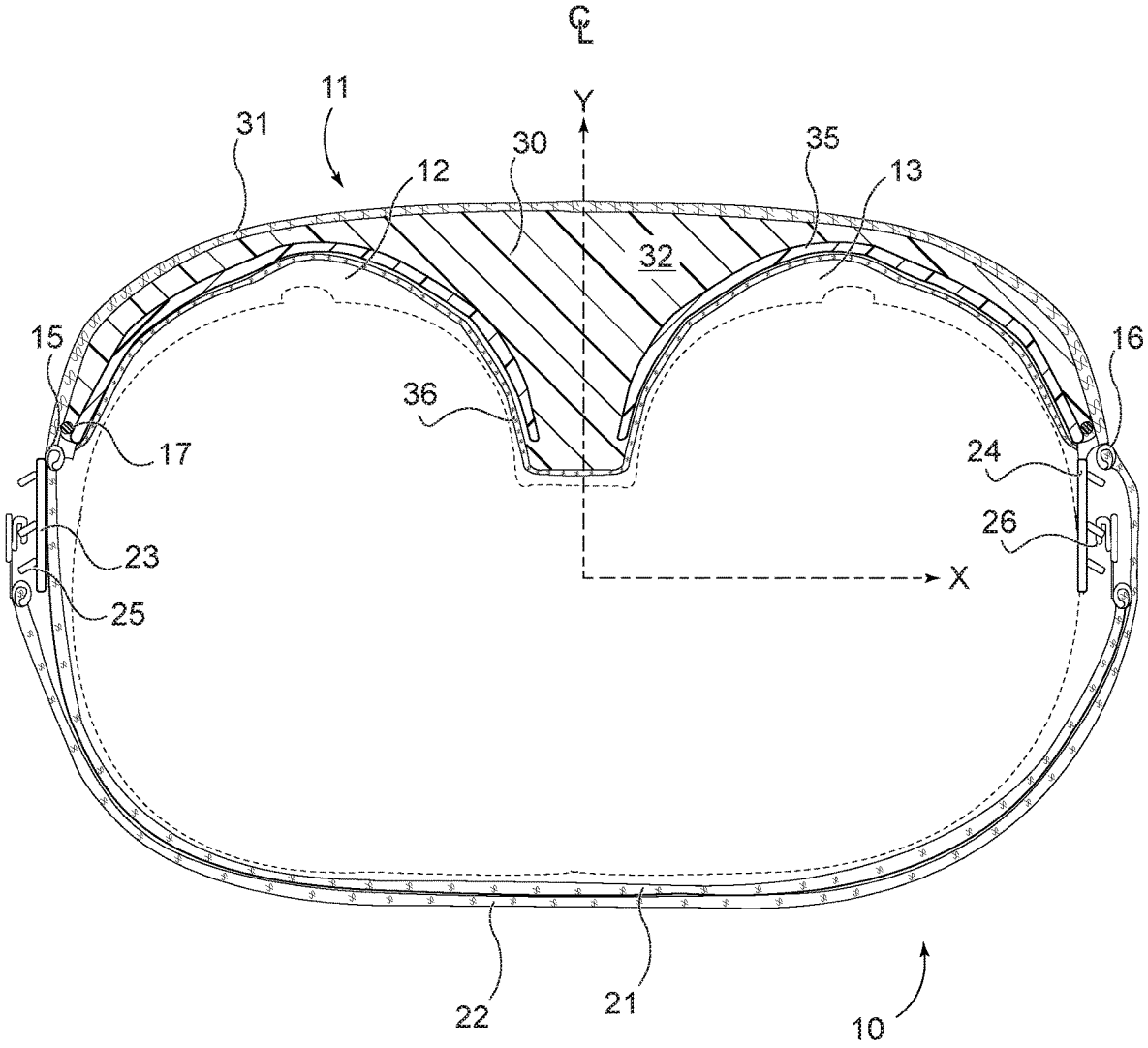
FIG. 5 is a cross-sectional view taken along line 5-5 in FIG. 2.

With reference to FIG. 5 a cross-sectional view taken along line 5-5 in FIG. 2 reveals a horizontal location and proximity of components. Particularly, regarding chest protection and immobilization of a wearer's breasts, the front panel 11 comprises an internal breast support layer 30 covered by an outer skin 31. The internal breast support layer includes but is not limited to: an inner pad support layer 32 covered by the outer skin 31; and a left 12 and a right 13 individual cup pad insert disposed into the inner pad support 32 (also FIG. 7). In other words, the individual cup inserts 34, 35, are positioned opposite the outer skin 31 with respect to the inner pad support layer 32. Also included for breathability and comfort is an inner skin fabric 36 contacting a wearer's skin that covers the left 34 and the right 35 individual cup pad inserts.

Also regarding FIG. 4 and FIG. 5 together, base support strap 11 is configured below and supporting a front panel 11 and a left 12 and a right 13 cup area therein. In one preferred arrangement, cup area 12, 13 will be comprised of three layers to include an internal breast support layer 30, surrounded by a stretchable breathable polyester outer skin 31, or similar material known in the art, configured to the outer portion and similarly (optionally) on the inner portion 36 contacting a wearer's skin. In other embodiments, cup area 12, 13 may be comprised of one or more layers. The materials employed in the construction of the first preferred embodiment and additional embodiments shall have wicking and breathability properties to wick sweat and moisture away and cool the wearer's skin.

Further in this embodiment, cup area 12, 13 is shown to provide full coverage of the wearer's breasts, though in other embodiments, breast coverage varies. The outer and inner portions of cup area 12, 13 continue outward from cup area 12, 13 to the ends of an outer back strap 22 and an outer fastener piece 23. The present embodiment 10 shows each of internal breast support layer 32 and left 34 and right 35 inner pad support as separate components. Other embodiments employ single pieces that perform equal function, each however, creating a clean and seamless outer appearance.

In one preferred embodiment, base support strap 14 continues outward from the lower ends of the front panel 11 along the bottom of outer back strap 22 and the bottom of an inner back strap 21. Base support strap 14 shall have considerable snap back strength, similar to spring force, providing support under the wearer's breast and keeping the invention in place on the wearer's torso during rigorous physical activity. Inner back strap 21 comprises a girdle or garter type material, or similar material known in the art, having considerable snap-back strength to keep the invention in place on the wearer's torso. Also shown (FIG. 5) is an inner fastener piece 24 that employs the same girdle or garter type material as inner back strap 21, and together, having ends containing complementary adjustable fastening components, such as eyes 25 and hooks 26 (FIG. 5). Alternatively, hook and loop type fasteners, or other similar fastening components known in the art, are provided for fastening the ends of each together near the right side 24 of the wearer's torso. Similarly, the ends of outer back strap 22 and outer fastener piece 23 employ adjustable fastening components 25, 26 for fastening the ends of each together near the right side of the wearer's torso, thus creating an outer support strap 22. In other embodiments the locations of the fastened ends of the inner 21 and outer 22 back straps may vary.

Again with reference to FIG. 5, a sectional view from an upper vantage point reveals layers of fabrics and materials 31, 32, 34, 35. Internal breast support layer 30 comprises breathable molded foam, or similar material known in the art, shaped to receive and encase the wearer's breasts 12, 13. In other embodiments, breast support layer 30 may employ one or more pieces of foam, or similar materials known in the art, to achieve the circumferential support of the wearer's breast. The first preferred embodiment will be available in standard cup sizes, while other embodiments may be available in customized or customizable sizes. While breast support layer 30 in this embodiment 10 is comprised of breathable, molded foam, or similar material known in the art, other embodiments may employ a material or materials which are moldable by the wearer in order for each high-performance sports bra to be customized by the wearer for their particular breast or body shapes.

Additionally with regard to FIG. 5, inner back strap 21 and outer back strap 22 are shown wrapped around the wearer's torso connected to respective outer 23 and inner 24 fastener piece creating the double enclosure cross over of back straps 21, 22.

In this first embodiment 10 and other embodiments, the construction of internal breast support layer 30 minimizes breast bounce by restricting the vertical and horizontal movement of the wearer's breasts and together with the double enclosure support system of the inner and outer back straps 21, 22, providing adequate support of the breasts and keeps the invention fully secured in place on the wearer's torso without the need for shoulder straps. All parts of the first preferred embodiment and other embodiments are appropriately sewn together, or attached by a similar known method in the art.

It should additionally be noted that support layers 30, 31 and pads 34, 35 are each comprised of one or more pieces of breathable molded foam, or a similar material known in the art, shaped to receive and provide support to the respective outward bottom and sides of the wearer's breasts. Individual cup pads 34, 35 are appropriately sewn or otherwise permanently attached to inner pad support layer 32. The internal breast support layer 30 is lined with a stretchable, breathable and comfortable polyester material 36, or similar material known in the art, on the inner portion 12, 13 that would contact a wearer's skin.

As before, the internal breast support layer 30, together with the outer and inner support straps 21, 22, minimizes breast bounce by restricting the vertical and horizontal movement of the wearer's breasts and provides adequate support thereof, keeping the invention fully secured in place on the wearer's torso during rigorous exercise or physical activity without the need for shoulder straps. The invention configuration could additionally useful as a chest protector for contact sports such as softball, field hockey, basketball, lacrosse or the like. Hence therefore, other embodiments may employ the invention 10 as the internal breast support system of a sports garment. All embodiments herein are created with optimum directional sewing and curvature of seams that are ideal for support.

Figure 6:
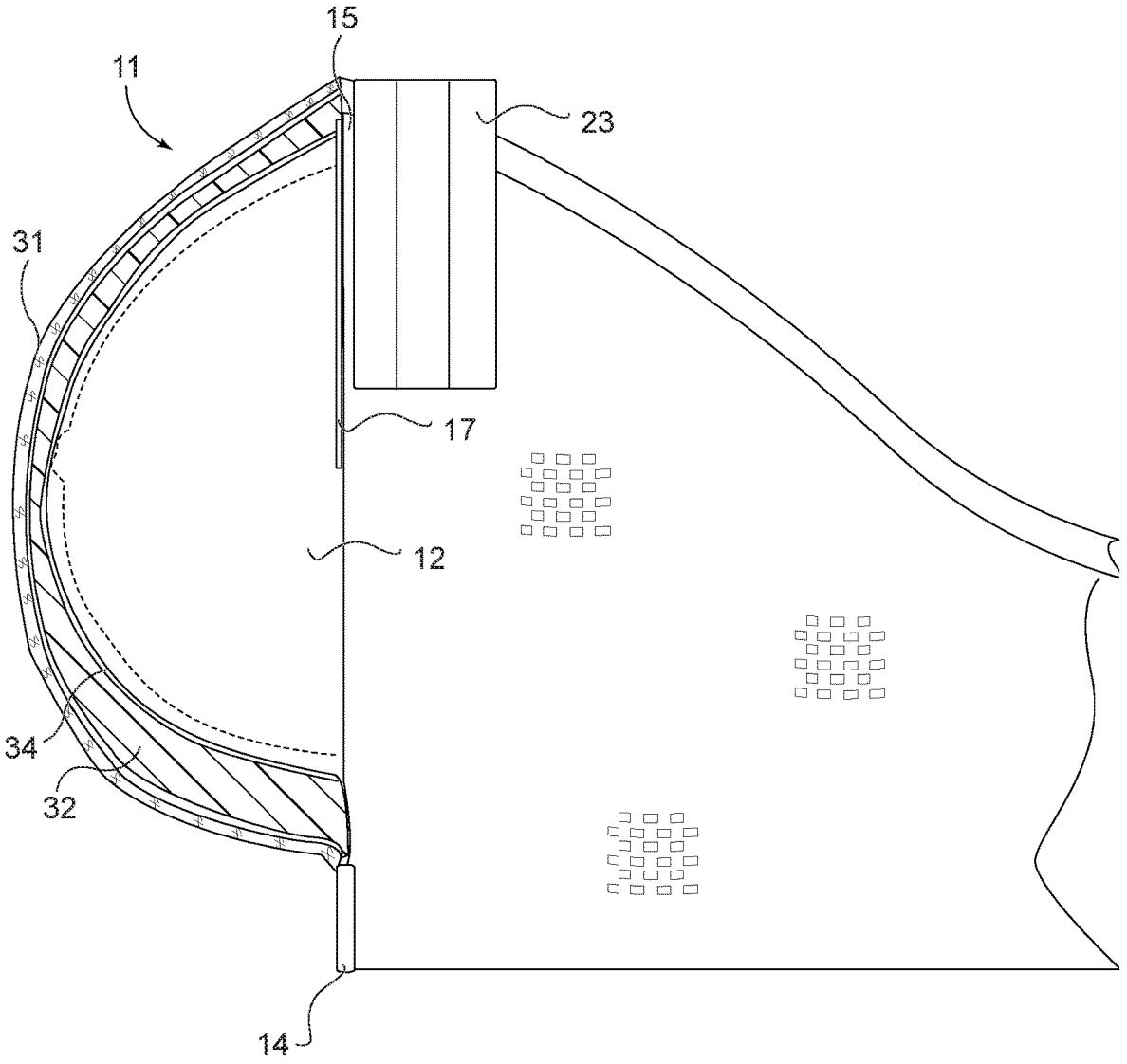
FIG. 6 is a partial section view taken along line 6-6 in FIG. 2.

FIG. 6 illustrates a partial cross sectional view of the first preferred embodiment 10 taken at a horizontal midpoint, line 6-6 in FIG. 2. As shown, internal breast support layer 30 provides support along the outside and sides of and in between the wearer's breasts creating a snug fit. Spacing in between the breasts and the inside surface of cup area 12, 13 is shown solely for illustrative purposes, as the inside surface of cup area 12, 13 is meant to make contact with the wearer's breasts.

Figure 7:
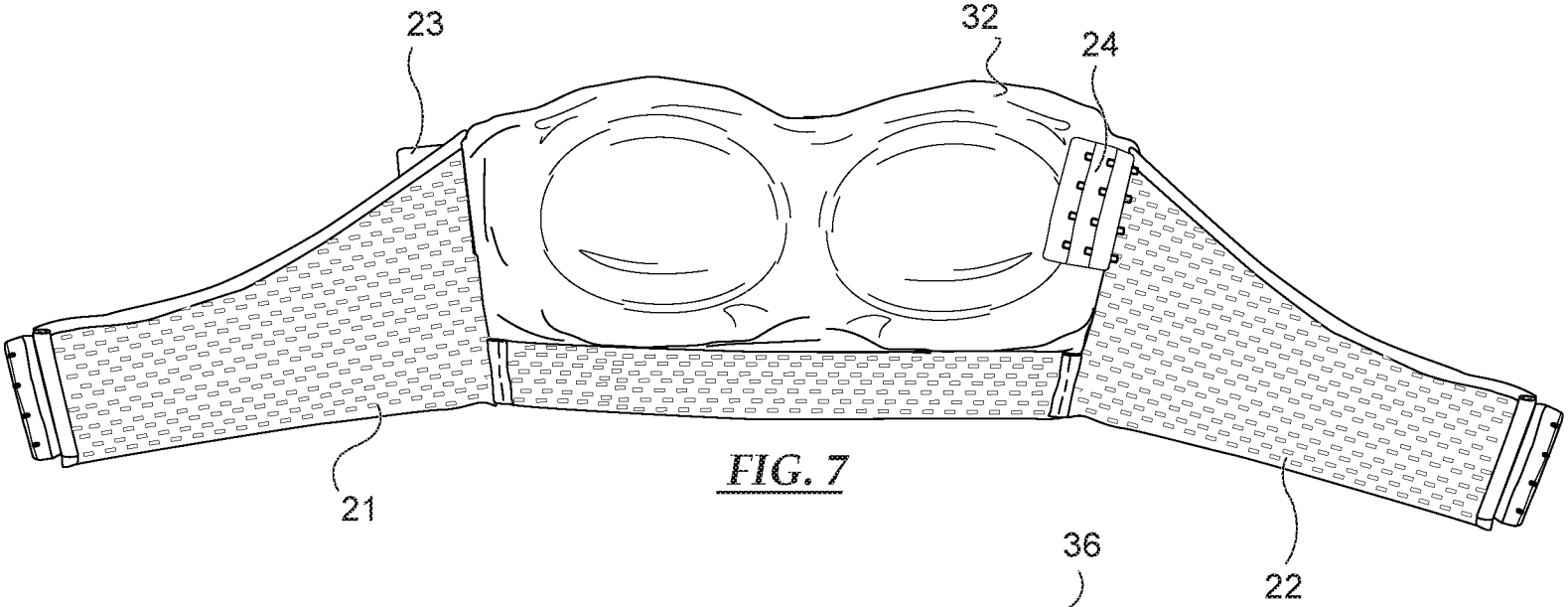
FIG. 7 is a rear isometric view of the device laid out and not in use.

FIG. 7 illustrates a rear isometric view of the device laid out and not in use and with the inner skin fabric 36 removed. Herein, the inner support strap 21 is to be fastened by the wearer first, with the wearer then fastening the outer support strap 22 over top of the inner support strap 21, which together create a dual hug or double enclosure support system.

FIG. 8 is an additional rear isometric view with certain components rearranged illustrating that left and right side configuration could be reversed. This embodiment also includes the inner skin fabric 36. Last but not least in the FIG. 7 and the FIG. 8 embodiment, base support strap 14, is configured starting at the first side 15 (FIG. 1 and FIG. 4) of the front panel 11 continuing to the second side 16 of the front panel and not continuing around to a rear of the sports bra (i.e. not continuing to outer back straps 21, 22 as in other embodiments), the base support strap 14 providing support to the left 12 and the right 13 cup area.

It should be understood, of course, that the foregoing relates to exemplary embodiments of the invention and that modifications may be made without departing from the spirit and scope of the invention as set forth in the following claims.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

While the particular High-Performance Sports Bra herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

I claim:

1. A sports bra comprising:

a front panel including a left and a right cup area;

a base support strap configured underneath the front panel providing security and support to the left and the right cup area;

an inner back strap extending from a first side of the front panel; and an outer back strap extending from a second side of the front panel, the second side of the front panel opposite the first side, wherein the inner back strap is removably coupled to a second lateral side of the sports bra adjacent to the second side of the front panel, and wherein the outer back strap is removably coupled to a first lateral side of the sports bra adjacent to the first side of the front panel, and further wherein the outer back strap is extending overlapping the inner back strap at the second side of the front panel being removably coupled thereto, further wherein the sports bra is devoid of any shoulder strap thereby being a sports bra that is a strapless sports bra, further wherein the outer back strap overlaps the inner back strap from the second side to the first side.

2. The sports bra of claim 1, wherein the base support strap extends only from the first side of the front panel to the second slide of the front panel and does not continue to extend to a rear of the sports bra.

3. The sports bra of claim 1, wherein the inner back strap crisscrosses with the outer back strap thereby providing a dual hug support further comprising a crisscross incident angle of 30 plus or minus 10 degrees at a bottom rear of the sports bra.

4. The sports bra of claim 1, wherein the inner back strap is removably coupled to the second lateral side of the sports bra via an inner back strap fastener piece adjacent to the second side of the front panel, and wherein the outer back strap is removably coupled to a first lateral side of the sports bra via an outer back strap fastener piece adjacent to the first side of the front panel.

5. The sports bra of claim 1, further comprising an internal breast support layer covered by an outer skin, the internal breast support layer comprising:

an inner pad support layer covered by the outer skin;

a left and a right individual cup pad insert disposed into the inner pad support layer, and opposite the outer skin with respect to the inner pad support layer; and an inner skin fabric configured adjacent to a wearer's skin covering the left and the right individual cup pad inserts.

6. The sports bra of claim 5, further comprising:

a first semi-rigid rod at the first side of the front panel; and a second semi-rigid rod at the second side of the front panel, wherein the internal breast support layer further comprises a third and a fourth semi-rigid rod configured adjacent to the left and the right individual cup pad inserts, the first, second, third and fourth semi rigid rods providing a partial endoskeleton and a measure of stiffness to the sports bra.

7. The sports bra of claim 5, wherein the internal breast support layer has a thickness being greatest at a center line, the center line being at a y-axis, further wherein the front panel has a continuous smooth curvature in a top aspect x-y plane.

* * * * *